US009328539B1

(12) United States Patent
Lonardo et al.

(10) Patent No.: US 9,328,539 B1
(45) Date of Patent: May 3, 2016

(54) MANACLE RESTRAINING DEVICE

(71) Applicants: Anthony E. Lonardo, Aurora, CO (US); Ewan R. Grantham, Castle Rock, CO (US)

(72) Inventors: Anthony E. Lonardo, Aurora, CO (US); Ewan R. Grantham, Castle Rock, CO (US)

( * ) Notice: Subject to any disclaimer, the term of this patent is extended or adjusted under 35 U.S.C. 154(b) by 0 days.

(21) Appl. No.: 14/444,631

(22) Filed: Jul. 28, 2014

(51) Int. Cl.

| | |
|---|---|
| ***E05B 75/00*** | (2006.01) |
| *E05B 67/00* | (2006.01) |
| *E05B 67/32* | (2006.01) |
| *E05B 73/00* | (2006.01) |

(52) U.S. Cl.
CPC ..... *E05B 75/00* (2013.01); *E05B 67/003* (2013.01); *E05B 67/32* (2013.01); *E05B 73/0005* (2013.01)

(58) Field of Classification Search
CPC ..... E05B 75/00; E05B 73/005; E05B 67/003; E05B 67/32
USPC ..... 70/15–18
See application file for complete search history.

(56) References Cited

U.S. PATENT DOCUMENTS

| | | | | |
|---|---|---|---|---|
| 4,071,023 | A | 1/1978 | Gregory | |
| 4,909,051 | A | 3/1990 | Lee | |
| 4,964,419 | A | 10/1990 | Karriker | |
| 5,088,158 | A | 2/1992 | Burkholder | |
| 5,159,728 | A | 11/1992 | Bingold | |
| 5,193,254 | A | 3/1993 | Geisinger | |
| D347,156 | S | 5/1994 | Starrett et al. | |
| 5,377,510 | A | 1/1995 | Smith | |
| 5,443,155 | A | 8/1995 | Robinson | |
| D366,129 | S | 1/1996 | Escoe, III | |
| D366,733 | S | 1/1996 | Stanchin | |
| 5,651,376 | A | 7/1997 | Thompson | |
| 5,794,461 | A | 8/1998 | Smith | |
| 5,797,404 | A | 8/1998 | Stanchin, II | |
| 5,802,888 | A * | 9/1998 | Parsons | 70/16 |
| 5,969,613 | A | 10/1999 | Yeager et al. | |
| 6,151,761 | A | 11/2000 | Thompson | |
| 6,163,935 | A * | 12/2000 | Hinkey | 24/71 TD |
| 6,196,033 | B1 | 3/2001 | Dowdle | |
| 6,219,887 | B1 | 4/2001 | Parsons | |
| 6,326,890 | B1 * | 12/2001 | Costa | 340/572.9 |
| 6,327,752 | B1 * | 12/2001 | Hinkey | 24/115 M |
| 6,334,444 | B1 | 1/2002 | Sisco | |
| 6,446,474 | B1 | 9/2002 | Tabacchi et al. | |

(Continued)

FOREIGN PATENT DOCUMENTS

| | | | |
|---|---|---|---|
| CN | 2893091 | Y | 4/2007 |
| CN | 201125604 | Y | 10/2008 |

(Continued)

*Primary Examiner* — Suzanne Barrett
*Assistant Examiner* — Morgan McClure
(74) *Attorney, Agent, or Firm* — The Reilly Intellectual Property Law Firm, P.C.

(57) ABSTRACT

In a restraining device for releasably securing a person's wrists or legs in which a pair of manacles are made of flexible loops or straps with ratchet teeth at one end of each strap and a lock housing at the opposite end of each strap, each housing is characterized by being of hollow generally triangular configuration with a channel for extension of the free end of each strap through the housing beneath a pawl arm in the housing which is controlled by a specially designed key. The key is guided into engagement with the pawl arm by an extension wall on a cover plate which is permanently attached to the outer side walls of the housing by a combination of notched ends on the cover plate and ultrasonic molding together of the cover plate with the outer side walls and an inner support wall in the housing.

9 Claims, 3 Drawing Sheets

(56) References Cited

U.S. PATENT DOCUMENTS

| | | | | |
|---|---|---|---|---|
| 6,532,631 | B2 | 3/2003 | Rohaly et al. | |
| 6,539,589 | B2 | 4/2003 | Thompson | |
| 6,615,622 | B2 | 9/2003 | MacAleese et al. | |
| 6,616,107 | B1 | 9/2003 | Hargreaves | |
| 7,121,122 | B2 | 10/2006 | Levi | |
| 7,131,168 | B2 | 11/2006 | Pangallo | |
| 7,284,399 | B1 | 10/2007 | Sisco | |
| 7,409,749 | B2 | 8/2008 | Caveney | |
| 7,578,532 | B2 | 8/2009 | Schiebler | |
| 7,582,089 | B2 | 9/2009 | Schiebler | |
| 7,719,421 | B2 | 5/2010 | Zovic et al. | |
| 7,866,321 | B2 | 1/2011 | DePetrillo | |
| 7,882,599 | B2 | 2/2011 | Harrington | |
| 7,900,324 | B2 * | 3/2011 | Ginocchio | 24/272 |
| 8,156,771 | B2 | 4/2012 | Kostal et al. | |
| 8,490,442 | B1 | 7/2013 | Dapkins, Jr. et al. | |
| 2003/0029207 | A1 * | 2/2003 | Young | 70/18 |
| 2003/0164009 | A1 * | 9/2003 | Levi | 70/18 |
| 2005/0262901 | A1 * | 12/2005 | Parsons et al. | 70/16 |
| 2006/0243004 | A1 * | 11/2006 | Johnson et al. | 70/16 |
| 2006/0272367 | A1 | 12/2006 | Kriesel | |
| 2008/0047307 | A1 * | 2/2008 | Kenney | E05B 75/00 70/16 |
| 2009/0205379 | A1 * | 8/2009 | Williams | 70/16 |
| 2010/0162775 | A1 | 7/2010 | Martinez | |
| 2010/0229608 | A1 | 9/2010 | Dapkins, Jr. et al. | |
| 2011/0167880 | A1 | 7/2011 | Klementowicz, III et al. | |
| 2012/0032805 | A1 | 2/2012 | Brodzik et al. | |
| 2012/0227446 | A1 * | 9/2012 | Shute et al. | 70/15 |
| 2013/0192314 | A1 * | 8/2013 | Cheng | 70/16 |
| 2014/0239144 | A1 * | 8/2014 | Lin | 248/551 |

FOREIGN PATENT DOCUMENTS

| | | | |
|---|---|---|---|
| DE | 102011053841 | A1 | 3/2013 |
| GB | 2453971 | A | 4/2009 |
| KR | 20110131419 | | 7/2011 |
| RU | 2074942 | C1 | 3/1997 |
| WO | 9902806 | A1 | 1/1999 |

* cited by examiner

MANACLE RESTRAINING DEVICE

BACKGROUND AND FIELD OF INVENTION

The following relates to restraining devices which can be used singly or in pairs to secure objects together or to secure a single object to a stationary member; and its primarily intended use is to be employed as manacles, often referred to as "handcuffs", for releasably securing a person's wrists or legs together.

Standard manacles or handcuffs employ a pair of rings which are in the form of loops which can be adjusted in size to fit securely around a person's wrists or ankles, and the cuffs are usually attached together by means of a chain. Such devices have been in widespread use for some period of time but there is an increasing interest and need for a light weight, temporary restraining device which is relatively inexpensive, sturdy and reusable but at the same time will effectively discourage unwarranted attempts by the person under restraint to separate or unlock the manacles without the correct size and shape of key. Further, it is highly desirable to provide for restraining devices of the type described which are conformable for use in different applications, are high strength but light weight and will prevent picking open by the person under or other unauthorized person and requires use of a particular size and shape of key to unlock each manacle or cuff.

A particular feature of my new and improved restraining device is the utilization of a housing with reinforced side walls and a cover plate attached in a unique matter to the outer side walls with inner side wall extensions to lend additional reinforcement and support to the outer side walls while limiting access to a release lever within the housing. In its preferred embodiment, the release lever is in the form of a pawl with a lever arm having teeth engageable with ratchet teeth on a free end of the strap for each manacle, the pawl and its support forming an integral part of the molding for the housing and serving as a part of the reinforcement for the housing.

DETAILED DESCRIPTION OF THE DRAWINGS

Figure 7:
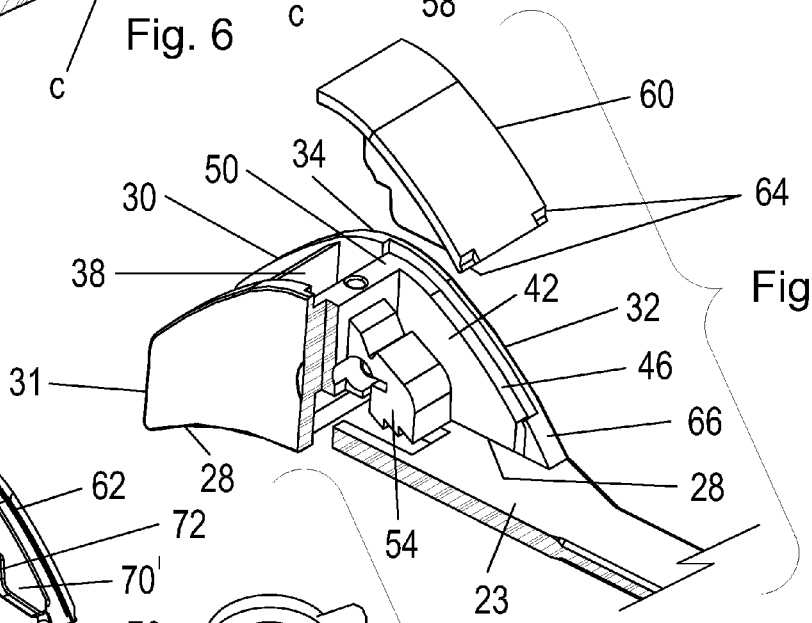
Figure 8:
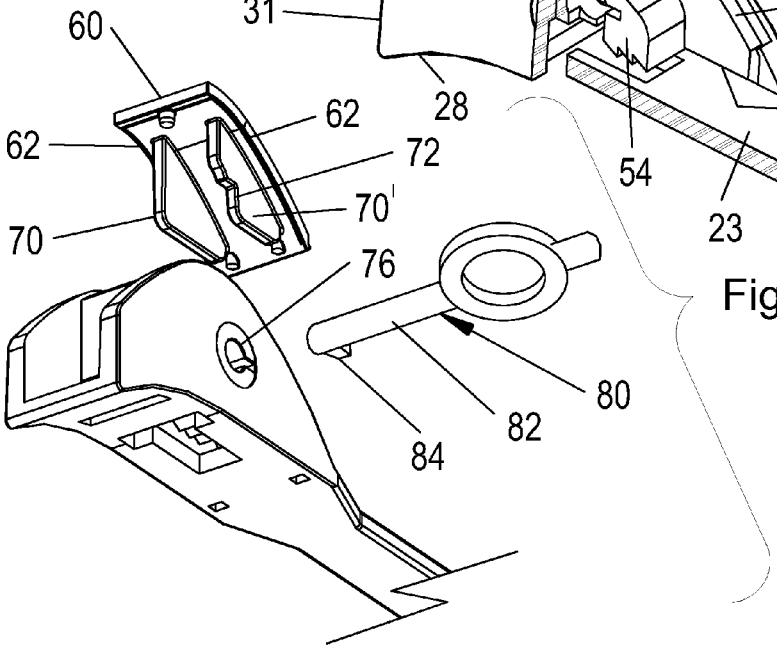

FIG. 7 is an exploded view partially in section illustrating the relationship between the cover plate and pawl prior to assembly and illustrating the interior of the key hole formed in the pawl; and FIG. 8 is another exploded view of the cover plate with respect to the housing taken from an underside of the housing and illustrating a key in relation to the key hole which extends through one outer side wall of the housing.

DETAILED DESCRIPTION OF PREFERRED EMBODIMENT

Figure 1:
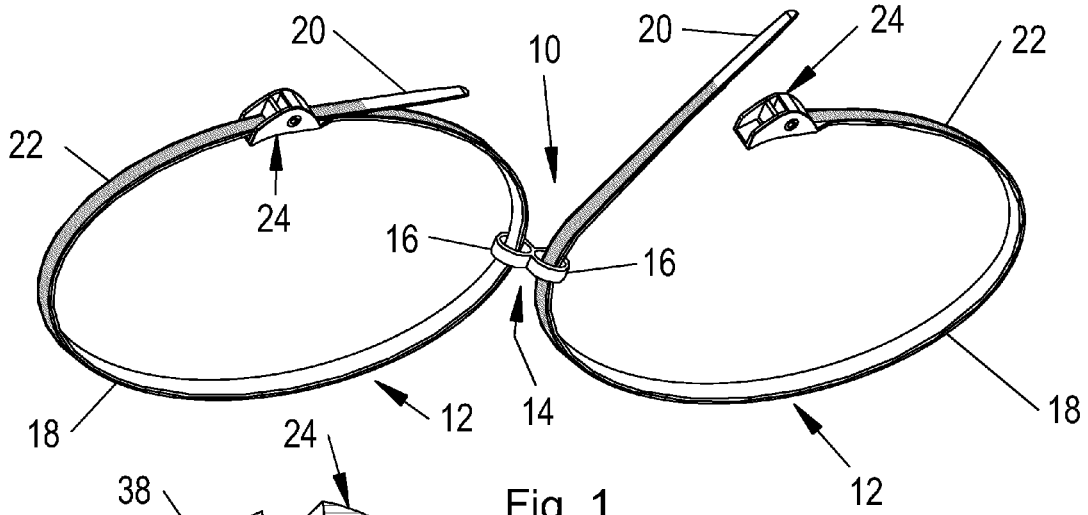
FIG. 1 is a perspective view of a pair of handcuffs releasably joined together to serve as a restraining device for securing a person's wrists or legs together.
Figure 2:
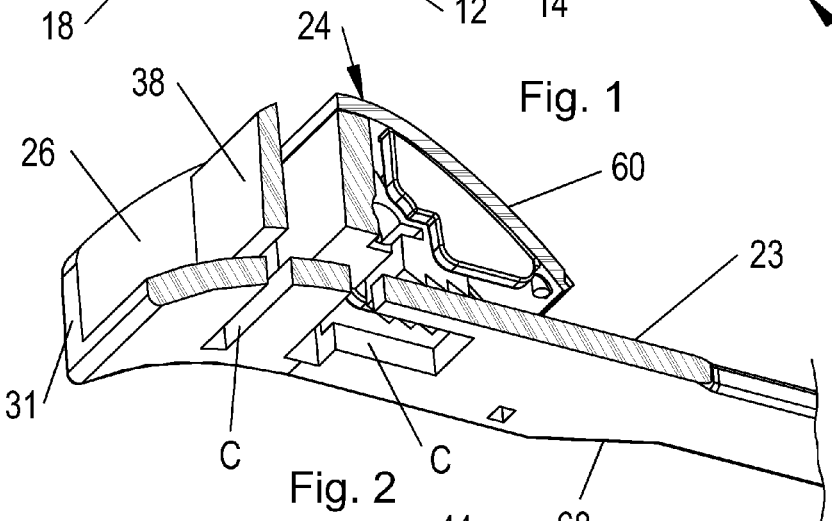
FIG. 2 is a perspective view of the housing for each one of the manacles.
Figure 3:
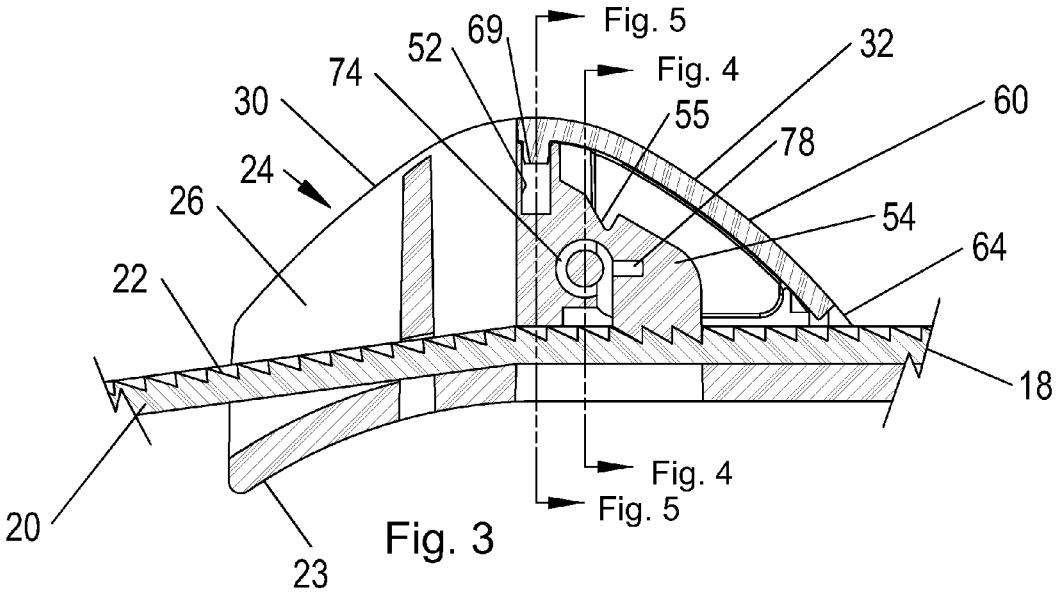
FIG. 3 is a longitudinal cross-section through the housing joined to a free end of the band or strap of each manacle.

There is illustrated in FIGS. 1 to 3 a restraining device 10 made up of a pair of manacles 12 which are loosely connected together by a coupling 14. The coupling 14 consists of a pair of rings 16 which in a conventional manner may be united either by a pivotal or fixed connector, not shown. Each coupling 16 is sized for loose insertion of a thin, flat and flexible strap 18 having a free end 20 with ratchet teeth 22 and an opposite end 23 which forms the base of a housing 24.

Figure 6:
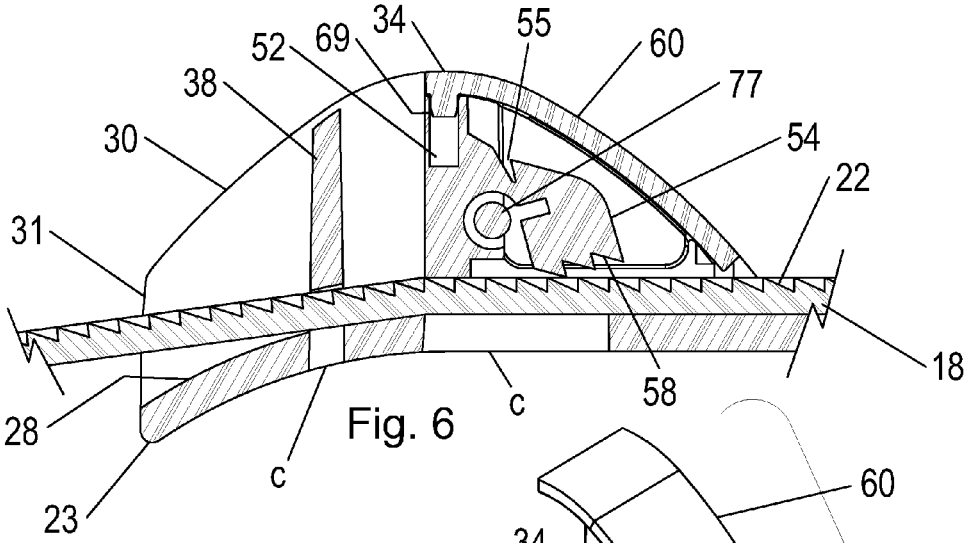
FIG. 6 is another longitudinal section view taken through the midsection of the housing and illustrating the pawl in a released or unlocked position with respect to the strap.

The housing 24 is of generally triangular configuration and has outer spaced side walls 26 extending in spaced parallel relation to one another and perpendicular to the base 23. Each of the triangular side walls 26 has a first triangular concave edge 28 joined to each of the opposite sides of the base 23; a second triangular edge 30 of generally convex configuration curves away from a straight edge 31 which is perpendicular to and joined to the base 23 at one end; and a third triangular convex edge 32 gradually curves away from an apex 34 into the base 23. Both edges 32 curve away from the apex 34 and are joined by a common transverse reinforcing wall 38, as best seen from FIGS. 6 and 7. Accordingly, the generally triangular configuration of the housing 24 is defined by the concave edge 28 along the base 23 and convex edges 30 and 32 which extend in opposite directions away from the apex 34, the inclined edges 30 being truncated somewhat by the straight edge 32 adjacent to the base 23.

In the interior of the housing, as shown in FIGS. 4 to 7, a generally U-shaped pawl support member 40 is made up of a pair of spaced, parallel intermediate side walls 42 extending away from and perpendicular to opposite sides of a common transverse support wall 44. The intermediate side walls 42 are molded to and conform to the outer tapered side walls 32 but are offset beneath the tapered edges of the outer side walls 30 to form opposed, facing ledges 46 between the convex surfaces 30 and 32 of the side walls 26.

As best seen from FIG. 7, an opposite corner 50 between each of the intermediate side walls 42 and opposite sides of the support wall 38 is joined to opposite sides of the wall 26. Similarly, the lower edge 43 of the transverse wall 44 is joined to the base 23, and a bore 52 extends centrally into the upper end of the transverse wall 44 to the base 23 for a purpose to be described. The transverse wall 44 serves as a rigid support for a pawl lever arm 54 extending parallel and in spaced relation to the intermediate side walls 42. The end of the lever arm 54 extends toward the base 23 and terminates in a series of teeth 58 which normally engage the ratchet teeth 22 at the end of the strap 23, and the arm 54 is bendable upwardly about a notched portion 55 in the arm.

The outer housing 24 is completed by a cover plate 60 of convex configuration conforming to the curvature of the edges 32 and having opposite sides 62 which fit into the ledges 46 from the apex 34 to the notched ends 64 of the plate 60. The ends 64 are notched as shown to fit tightly into complementary notched edges 66 which extend away from widened ends 68 of the walls 26 to firmly lock the lower ends 66 in place. A center peg 69 at the center of the cover plate 60 fits tightly into the center bore 52 of the wall 44, which is used to aid in the locating of the cover plate 60 onto the outer housing 64 during assembly and ultra-sonic welding.

Figure 2A:
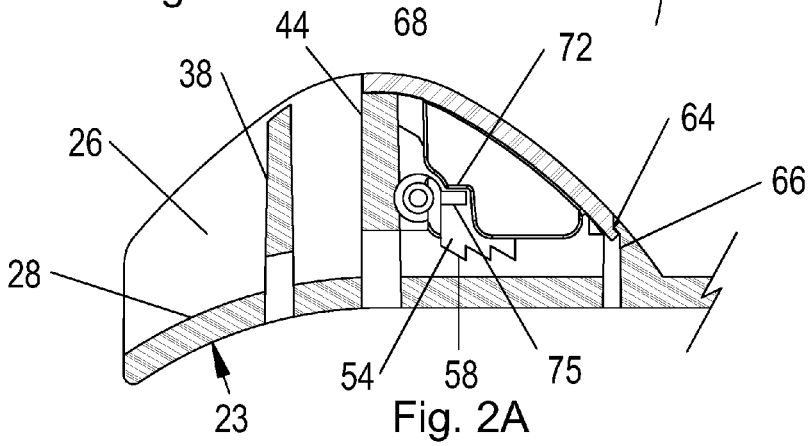
FIG. 2A is a side view partially in section with the side wall removed to illustrate the relationship between an inner side wall extension and key hole.
Figure 4:
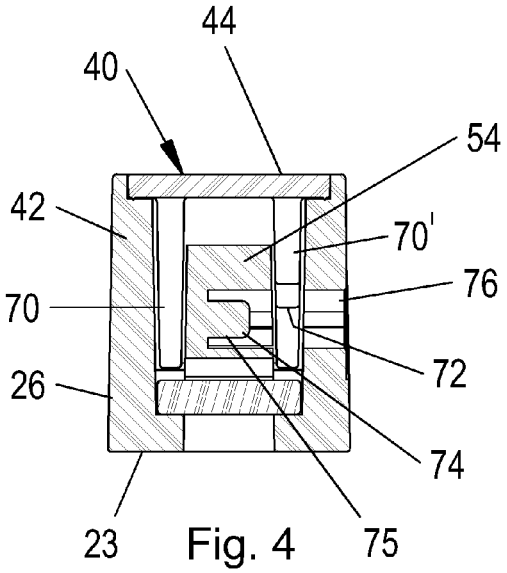
FIG. 4 is a cross-sectional view taken about lines 4-4 of FIG. 3.
Figure 5:
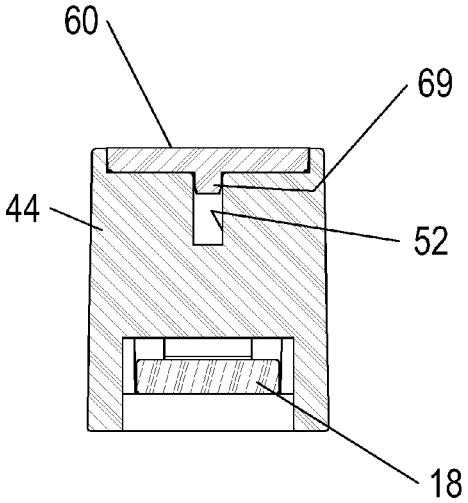
FIG. 5 is another cross sectional view taken about lines 5-5 of FIG. 3.

An important feature is to provide auxiliary wall extensions 70 and 70' on the cover plate 60 which extend from the under surface of the cover plate 60 into closely spaced relation to and between the pawl 54 and the inner surfaces of the walls 46, as best seen from FIG. 4. Both walls 70 and 70' are of generally triangular configuration but the wall 70' includes a notched or recessed area 72 between the key hole 74 in the body of the pawl 54 and the entrance 76 to the key hole 74 which extends through the outer wall 32 on the side of the housing facing the key hole 74. As illustrated in FIGS. 2 and 2A the notched area 72 recedes away from the center of the key hole 74 and extends parallel to the lateral extension 75 to enable insertion of a key 80 which is provided with a shank 82 and a lateral extension 84. The key 80 can be advanced into the key hole 74 and its lateral slot 75 which is formed in the lever extension arm 54 of the pawl. Rotation of the key in a counterclockwise direction is capable of exerting enough pressure on the arm 54 about the weakened portion 55 to raise the teeth 58 from engagement with the ratchet teeth 22. The key 80 is specially designed with a hollow shank 82 which will slide over the center pin 77 in the key hole 74 when the lateral projection 84 enters the slot 78. In this way, the center pin 77 provides enough leverage for rotation of the key 80 and its lateral projection 84 upwardly to raise the arm 54. Further, the notched or recessed area 72 cooperates with the center pin 77 in requiring a specific design of key which can enter the key hole and exert sufficient pressure on the pawl arm to separate the teeth 58 from the ratchet teeth 22.

In a preferred method of making the manacle, the pawl assembly is an integral part of the molding for each handcuff together with the housing and strap. The cover plate is attached by ultrasonic welding along opposite edges which fit into the ledges of the outer side walls of the housing, and the cover plate is also positively attached as described by the notched areas at the base. The unitary housing construction is achieved with the use of the pass cores C and vertical shut offs defined by the walls 38 and 40. The location on the notch or weakened portion 55 in the pawl arm is important in creating a moment arm for upward bending of the pawl, although it will be apparent that the notch can be a different configuration and be repositioned as long as it does not alter the force required to unlock.

It is to be understood that only a preferred form of restraining device is herein set forth and described, and various modifications and changes may be made in the specific construction and arrangement of elements without departing from the spirit and scope of this disclosure.

We claim:

1. A manacle comprising:

an elongated flexible strap having a first series of ratchet teeth on one surface adjacent to one end of said strap;

a housing joined to an opposite end of said strap having a channel extending through a base of said housing over said opposite end of said strap and through which said one end of said strap extends over said opposite end of said strap, said housing having outer sidewalls, a support wall at one end, and a keyhole extending through one of said outer sidewalls of said housing in a direction transversely to the length of said channel provided with a lateral slot extending radially outwardly from said keyhole into said pawl arm;

a pawl arm of limited flexibility mounted in said housing on said support wall including a second series of ratchet teeth at one end with said keyhole extending into said pawl arm; and a cover plate on said housing having at least one inner sidewall extending parallel to and between said pawl arm and said one of said outer sidewalls of said housing through which said keyhole extends, said inner sidewall terminating in a bottom edge comprising first and second notches which are aligned with the keyhole and the lateral slot and wherein the bottom edge of the inner sidewall is aligned with the pawl arm and disposed adjacent thereto whereby to permit entry and rotation of a key to force said pawl arm in a direction releasing said second series of ratchet teeth from said first series of ratchet teeth; and a lateral projection on said key aligned with said lateral slot in said keyhole whereby insertion of said lateral projection into said lateral slot and rotation away from said first series of ratchet teeth will rotate said second series of ratchet teeth on said pawl arm away from engagement with said first series of ratchet teeth thereby causing said opposite end of said strap to be released from said housing.

2. A manacle according to claim 1 wherein said cover plate has a pair of opposite sidewalls disposed parallel to said outer sidewalls of said housing, one end of said cover plate including a stud inserted into a support wall in said housing, said stud being secured into fixed relation to said support wall.

3. A manacle according to claim 2 wherein said cover plate includes a pair of intermediate sidewalls extending from said support wall between said outer sidewalls and said opposite sidewalls of said cover plate, said cover plate extending toward said base of said housing and terminating in ends of said opposite sides of said cover plate extending into tightly fitting relation to slots adjacent to said base.

4. A manacle according to claim 3 wherein said ends of said cover plate are provided with pegs extending into openings in said base of said housing, said pegs being molded into fixed relation to said base.

5. A manacle according to claim 1 wherein said support wall extends between said outer sidewalls of said housing and said pawl arm is affixed in unitary relation to said support wall.

6. A manacle comprising:

an elongated flexible strap having a series of ratchet teeth on one surface adjacent to one end of said strap;

a housing joined to an opposite end of said strap including a channel extending through a base of said housing over said opposite end of said strap and through which said one end of said strap extends over said opposite end of said strap, said housing having outer sidewalls, a support wall at one end of said housing and a keyhole extending through one side of said housing in a direction transversely to the length of said channel provided with a lateral slot extending radially outwardly from said keyhole into said pawl arm;

a pawl arm mounted in said housing with said keyhole extending partially into said pawl arm with a pair of intermediate sidewalls extending from opposite sides of said support wall adjacent to and between said outer sidewalls; and a cover plate on said housing having at least one inner sidewall extending parallel to and between said pawl arm and one side of said housing through which said keyhole extends, said inner sidewall terminating in a bottom edge comprising first and second notches which are aligned with the keyhole and the lateral slot and aligned with a radial edge of said lateral slot whereby to permit entry of a key into said keyhole; and wherein said cover plate has opposite side edges affixed to ledges on opposite sidewalls of said housing, one end of said cover plate including a peg inserted into a support wall in said housing, said peg being molded into fixed relation to said support wall; and a lateral projection on said key aligned with said lateral slot in said keyhole whereby to permit said lateral slot to receive said lateral projection to lift said pawl arm away from engagement with said ratchet teeth thereby releasing said opposite end of said strap from said housing.

7. A manacle according to claim 6 wherein said ledges and said opposite sides of said cover plate extend toward said base of said housing, and terminal ends of said opposite sides of said cover plates extending into tightly fitting relation to slots in said sidewalls adjacent to said base.

8. A manacle according to claim 7 wherein lower ends of said cover plate are provided with pegs extending into openings in said base of said housing, said pegs being molded into fixed relation to said base.

9. A manacle according to claim 6 wherein said support wall extends between opposite sides of said housing, and said pawl arm is affixed in unitary relation to said support wall.

* * * * *